US007695375B2

(12) United States Patent
Kaczmarz et al.

(10) Patent No.: US 7,695,375 B2
(45) **Date of Patent: *Apr. 13, 2010**

(54) GOLF CLUB SHAFT ANGLE ADJUSTMENT TECHNOLOGY

(76) Inventors: Gregory Andrew Kaczmarz, 3 Savile Ave., Winnipeg, Manitoba (CA) R3R 2T4; Bruce M Kisell, 139 Novara Drive, Winnipeg, Manitoba (CA) R2P 2X9; Johanna P Lalman, 139 Novara Drive, Winnipeg, Manitoba (CA) R2P 2X9; Tracy R Young, 6 Waiter Copp Crescent, Winnipeg, Manitoba (CA) R2K 4H6; Mike J. Bartmanovich, 129 Stoney Lake Bay, Winnipeg, Manitoba (CA) R3W 1L1

( * ) Notice: Subject to any disclaimer, the term of this patent is extended or adjusted under 35 U.S.C. 154(b) by 0 days.

This patent is subject to a terminal disclaimer.

(21) Appl. No.: 12/081,697

(22) Filed: Apr. 21, 2008

(65) Prior Publication Data

US 2009/0264215 A1 Oct. 22, 2009

(51) Int. Cl.
*A63B 53/02* (2006.01)
*A63B 53/06* (2006.01)

(52) U.S. Cl. ..... 473/244; 473/248; 473/313; 473/340; 473/342; 473/251

(58) Field of Classification Search ..... 473/244–248, 473/305–315, 251, 40, 342
See application file for complete search history.

(56) References Cited

U.S. PATENT DOCUMENTS

| | | | | | |
|---|---|---|---|---|---|
| 2,661,952 | A * | 12/1953 | Jackson | ..... | 473/248 |
| 4,735,414 | A * | 4/1988 | Williams et al. | ..... | 473/248 |
| 6,120,384 | A * | 9/2000 | Drake | ..... | 473/248 |
| 6,527,649 | B1 * | 3/2003 | Neher et al. | ..... | 473/248 |

* cited by examiner

*Primary Examiner*—Sebastiano Passaniti

(57) ABSTRACT

A front of the club head consists of a round opening that accepts a corresponding round member on the end of the shaft. The face of the club inside the round opening on the club head as well as the face of the shaft member that opposes the face of the club inside the round opening on the club head includes half-spherical divots. Opposing divots are positioned in-line when the shaft is at an allowable angle. A ball bearing inserts into the in-line divots prior to sliding the shaft member into the club head opening to prevent movement when tightened. Inside the club head round opening is a smaller round opening that extends through the back of the club head. The round member on the end of the shaft has an attached threaded post that inserts into the smaller round opening on the club head.

1 Claim, 2 Drawing Sheets

GOLF CLUB SHAFT ANGLE ADJUSTMENT TECHNOLOGY

BACKGROUND OF THE INVENTION

This invention relates to the field of golf, specifically technology that allows the angle of the shaft of a golf club (ie. the lie) to adjust in small increments. A golf club shaft is typically fixed to the head and cannot be adjusted in such a way as to change the lie. This fixed angle is not always the best position for a golfer addressing the ball due to the golfer's size, stature, and/or style of play. This invention was conceived when a method was sought to allow for not only an adjustable shaft angle, but also the ability to adjust the shaft angle in small increments and prevent movement at the point where the shaft connects to the club head, when tightened. This invention improves on the technology described in my prior patent, U.S. Pat. No. 6,527,649.

BRIEF SUMMARY OF THE INVENTION

A golf club shaft angle adjustment technology is described that allows the angle of the shaft of a golf club (ie. the lie) to adjust in small increments, and prevents movement as is the case with gears or teeth.

The front of the club head consists of a round opening that accepts a corresponding round member on the end of the shaft. The face of the club inside the round opening on the club head consists of a series of half-spherical divots. The face of the shaft member that opposes the face of the club inside the round opening on the club head also has half-spherical divots. Opposing divots are positioned such that two opposing divots are perfectly in-line when the shaft is at an allowable angle. A ball bearing inserts into the perfectly in-line opposing divots prior to sliding the shaft member into the club head opening to prevent movement when tightened.

Inside the club head round opening is a smaller round opening that extends through the back of the club head. The round member on the end of the shaft has an attached threaded post that inserts into the smaller round opening of the club head and allows for the tightening of the round shaft member to the club head from the back of the club head, with a nut.

Moving the ball bearing to a different pair of perfectly in-line divots will cause the shaft angle to change. The technology will allow the user to adjust the angle of the shaft in fine increments, and the ball bearing will prevent undesirable movement between the attaching parts.

DETAILED DESCRIPTION OF THE INVENTION

Figure 1:
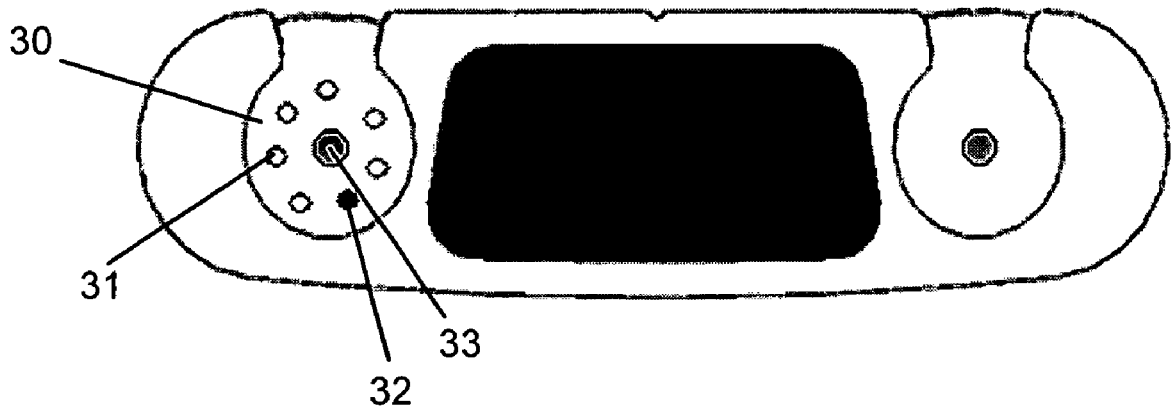
FIG. 1 is a front view of the round hole in the front face of the club, showing the half-divots, ball bearing, and smaller hole through to the back of the club head for the threaded post of the attaching round shaft member.

FIG. 1 shows a front view of the round hole in the front face of the club, showing the half-divots, ball bearing, and smaller hole through to the back of the club head for the threaded post of the attaching round shaft member.

Referring to FIG. 1, golf club shaft angle adjustment technology includes a round hole in the front face of the club 30, series of half-divots 31, a ball bearing 32 seated in one of the half-divots, and a smaller hole through to the back of the club head 33 for the threaded post of the attaching round shaft member.

Figure 2:
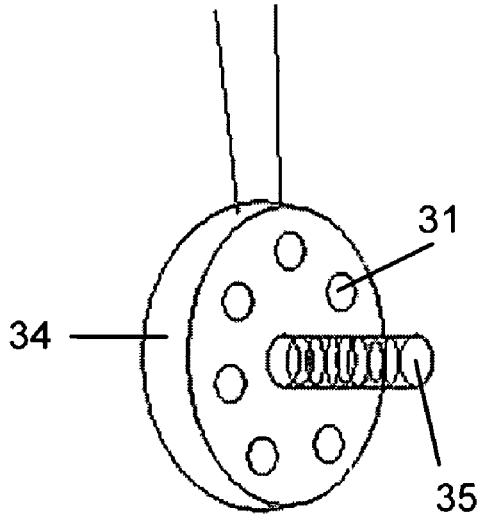
FIG. 2 is a front view of the round shaft member showing the threaded post and half divots.

FIG. 2 is a front view of the round shaft member 34 showing the threaded post 35 and half divots 31.

Figure 3:
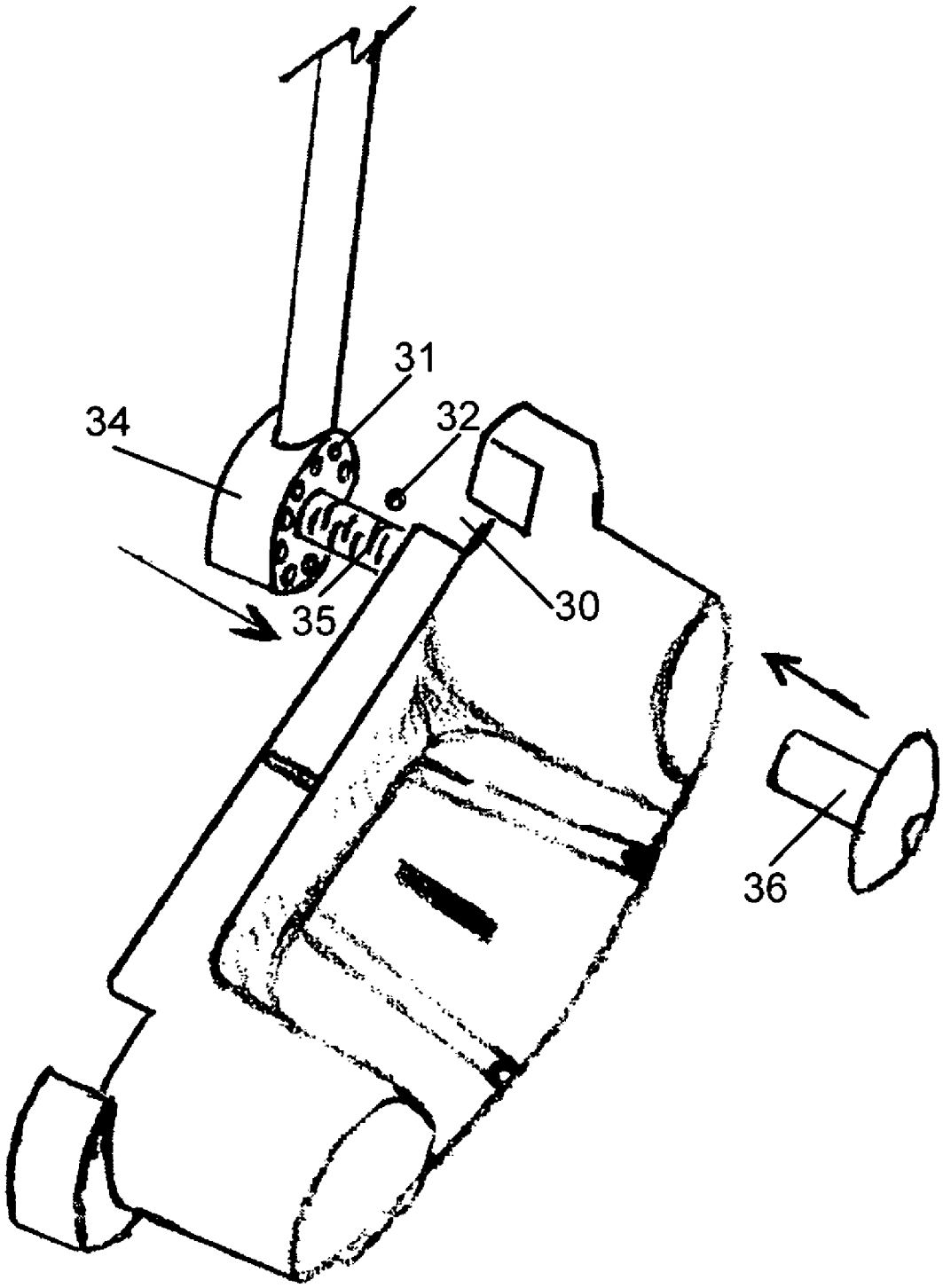
FIG. 3 is an exploded isometric view of the present invention.

FIG. 3 is an exploded isometric view of the present invention. The round shaft member 34 fits into the round hole in the front face of the club 30. The threaded post 35 fits into the smaller hole (hidden from view) through the back of the club head and accepts a nut 36. The ball bearing 32 fits between two perfectly in-line divots 31 (the divots in the round hole in the front face of the club are hidden from view). Both the round shaft member and the club head are tightened together using the threaded post 35 and the nut 36.

The technology will allow the user to adjust the angle of the shaft in fine increments, and the ball bearing will prevent undesirable movement between the attaching parts. The combination of these features provides the golfer with the unique ability to adjust the golf club to suit the golfer's size, stature, and style of play.

The invention claimed is:

1. A golf club shaft angle adjustment assembly comprising:

a shaft;

a club head having a face arranged for striking a golf ball and a back arranged opposite the face of the club head;

said shaft having, at one end, a round member with a face that opposes the face of the club head when the shaft is attached to the club head;

a round opening in the face of the club head for receiving the round member;

a smaller round opening through the center of the round opening in the face; said smaller opening configured to open to the back of the club head for accepting a threaded post there-through;

a threaded post attached to the round member and arranged to extend through the smaller opening;

a nut removably attached to the threaded post from the back of the club head to secure the round member to the club head;

an adjustable fastening arrangement that makes use of a substantial portion of the mating surfaces of both the opposing face of the round member and the round opening in the face of the club head; said adjustable fastening arrangement including a combination of half-spherical divots and a ball bearing;

the round opening in the face of the club head and the opposing face of the round member each have a plurality of said half-spherical divots thereon spaced substantially evenly apart and arranged in a substantially circular path adjacent to the perimeter of each of the round opening in the face of the club head and the opposing face of the round member; said ball bearing fitting inside two of said half-spherical divots that face one another when said face of said round member is fitted against the round opening in the face of the head to orient the shaft with respect to the club head at a particular angle.

* * * * *